US010220284B2

(12) United States Patent
Salcedo

(10) Patent No.: US 10,220,284 B2
(45) Date of Patent: Mar. 5, 2019

(54) PUNCHING BALL

(71) Applicant: Avantgarde Sport Inc., Dollard-des Ormeaux (CA)

(72) Inventor: Cedric Salcedo, Dollard-des Ormeaux (CA)

(73) Assignee: Avantgarde Sport Inc., Dollard-des Ormeaux, QC (CA)

( * ) Notice: Subject to any disclaimer, the term of this patent is extended or adjusted under 35 U.S.C. 154(b) by 0 days.

(21) Appl. No.: 15/149,493

(22) Filed: May 9, 2016

(65) Prior Publication Data

US 2016/0317894 A1 Nov. 3, 2016

Related U.S. Application Data

(63) Continuation of application No. PCT/CA2014/051093, filed on Nov. 14, 2014.

(Continued)

(51) Int. Cl.
*A63B 37/06* (2006.01)
*A63B 39/00* (2006.01)

(Continued)

(52) U.S. Cl.
CPC ..... *A63B 69/203* (2013.01); *A63B 37/06* (2013.01); *A63B 39/00* (2013.01); *A63B 41/00* (2013.01);

(Continued)

(58) Field of Classification Search
CPC ..... A63B 21/0004; A63B 21/00069; A63B 21/00178; A63B 21/00181; A63B 21/00185; A63B 21/008; A63B 21/0085; A63B 21/02; A63B 21/028; A63B 21/0442; A63B 21/055; A63B 21/0552; A63B 21/0555; A63B 21/0557; A63B 21/0601; A63B 21/0602; A63B 21/0607; A63B 21/065; A63B 21/068; A63B 21/08;

(Continued)

(56) References Cited

U.S. PATENT DOCUMENTS 4,071,241 A * 1/1978 Cortes Garcia ..... A63B 43/02 273/DIG. 19
4,361,912 A * 12/1982 Arthur ..... A63B 69/004 2/18

(Continued)

FOREIGN PATENT DOCUMENTS

CA 2685863 A1 5/2011
CN 2535095 Y 2/2003

(Continued)

OTHER PUBLICATIONS

The online video, "Wall Ball Boxing," (https://www.youtube.com/watch?v=8uiMKEZ7mNl, Aug. 12, 2008).*

(Continued)

*Primary Examiner* — Gary D Urbiel Goldner
(74) *Attorney, Agent, or Firm* — Anglehart et al.

(57) ABSTRACT

A spherical punching ball specifically designed for striking against a wall is disclosed. Embodiments with varied weight, size, rebound characteristics, density parameters, and other considerations are disclosed. Methods of construction, training, and related safety considerations are disclosed.

9 Claims, 7 Drawing Sheets

Related U.S. Application Data

(60) Provisional application No. 61/905,293, filed on Nov. 18, 2013.

(51) Int. Cl.
*A63B 41/00* (2006.01)
*A63B 69/00* (2006.01)
*A63B 69/20* (2006.01)

(52) U.S. Cl.
CPC ..... *A63B 69/004* (2013.01); *A63B 69/20* (2013.01); *A63B 69/205* (2013.01); *A63B 69/0097* (2013.01); *A63B 2037/065* (2013.01)

(58) Field of Classification Search
CPC . A63B 21/16; A63B 21/1618; A63B 21/1627; A63B 21/1636; A63B 21/1645; A63B 21/1654; A63B 21/1663; A63B 21/1681; A63B 21/169; A63B 21/4023; A63B 21/4043; A63B 23/12; A63B 23/1209; A63B 23/1245; A63B 23/1281; A63B 23/14; A63B 37/02; A63B 37/06; A63B 37/08; A63B 37/12; A63B 2037/065; A63B 2037/085; A63B 39/00; A63B 39/02; A63B 39/025; A63B 39/04; A63B 39/06; A63B 2039/003; A63B 2039/006; A63B 2039/022; A63B 41/00; A63B 41/02; A63B 41/04; A63B 41/08; A63B 41/10; A63B 41/12; A63B 69/004; A63B 69/0097; A63B 69/20; A63B 69/201; A63B 69/203; A63B 69/205; A63B 69/206; A63B 69/208; A63B 69/24; A63B 69/26; A63B 69/32; A63B 69/325; A63B 69/34; A63B 69/345; A63B 2208/0204; A63B 2225/62; A63B 2244/10; A63B 2244/102; A63B 2244/104; A63B 2244/106; A63B 2244/108
See application file for complete search history.

(56) References Cited

U.S. PATENT DOCUMENTS

| | | | | | |
|---|---|---|---|---|---|
| 4,463,951 | A * | 8/1984 | Kumasaka | A63B 37/02 | 273/DIG. 5 |
| 4,542,902 | A * | 9/1985 | Massino | A63B 37/02 | 273/DIG. 20 |
| 4,614,339 | A * | 9/1986 | Schanwald | A63B 37/00 | 273/DIG. 20 |
| 4,934,698 | A * | 6/1990 | Lary | A63B 37/06 | 473/125 |
| 4,953,852 | A * | 9/1990 | Donohue | A63B 69/205 | 482/86 |
| 5,147,258 | A * | 9/1992 | Donohue | A63B 69/205 | 482/83 |
| 5,358,258 | A * | 10/1994 | Killion | A63B 69/002 | 273/DIG. 19 |
| 5,433,438 | A | 7/1995 | Gilman | | |
| 6,402,647 | B1 * | 6/2002 | Haseltine | A63B 41/00 | 473/423 |
| 6,916,262 | B2 * | 7/2005 | Lacroix | A63B 41/00 | 473/593 |
| 7,699,726 | B2 * | 4/2010 | Avis | A63B 41/08 | 428/166 |
| 8,475,298 | B2 * | 7/2013 | Ogg | A63B 37/0003 | 473/376 |
| 8,663,073 | B1 | 3/2014 | Hays | | |
| 2001/0034279 | A1 * | 10/2001 | Veilleux | A63B 41/00 | 473/593 |
| 2003/0096663 | A1 * | 5/2003 | Kasashima | A63B 37/0004 | 473/371 |
| 2004/0110607 | A1 | 6/2004 | Crespo | | |
| 2005/0124445 | A1 * | 6/2005 | Veilleux | A63B 41/00 | 473/593 |
| 2006/0205547 | A1 * | 9/2006 | O'Neill | A63B 41/12 | 473/599 |
| 2009/0069122 | A1 * | 3/2009 | Laliberty | A63B 41/08 | 473/415 |
| 2012/0004050 | A1 * | 1/2012 | Ichikawa | A63B 37/0023 | 473/374 |
| 2013/0196786 | A1 * | 8/2013 | Ishii | A63B 37/0076 | 473/371 |
| 2014/0274504 | A1 * | 9/2014 | Hu | A63B 37/06 | 473/604 |

FOREIGN PATENT DOCUMENTS

| | | | |
|---|---|---|---|
| FR | 2940622 | A1 | 7/2010 |
| JP | 3168590 | U | 6/2011 |
| WO | WO 2007/012830 | A2 | 2/2007 |

OTHER PUBLICATIONS

Introducing wall ball, https://vimeo.com/103936888.
PCT/CA2014/051093 Written Opinion.
PCT/CA2014/051093 ISR with related claims.
PCT/CA2014/051093 Search Strategy.
Wall ball boxing, https://www.youtube.com/watch?v=8uiMKEZ7mNl.

* cited by examiner

PUNCHING BALL

This application is a continuation of PCT application PCT/CA2014/051093 filed Nov. 14, 2014, which claims priority of U.S. provisional patent application 61/905,293 filed Nov. 18, 2013.

TECHNICAL FIELD

The present invention is directed to the field of athletic training exercise balls.

BACKGROUND

Three broad types of apparatuses for practicing punching, kicking, or other striking maneuvers by human athletes are in contemporary use. Such devices are often well-known and used by athletes involved in training for boxing- or martial arts-like activities, and may be subdivided into the distinct categories of speed balls/bags (FIG. 1*a*), double-end balls/bags (FIG. 1*b*), and heavy bags (FIG. 1*c*). While such designs have been used for training in various fields of boxing and martial arts for many years, their underlying designs each possess various key shortcomings.

One such shortcoming relates to installation complexity. The inventor has found that the aforementioned punching ball/bag designs typically involve considerable installation requirements. For example, the speed ball requires a platform with the necessary swivel mechanism that attaches to the ball. Likewise, the double-ended ball/bag requires lower and upper anchor points (typically for fixing, respectively, to the floor and to the ceiling) to which the top and bottom elastic cords of the ball attach. Finally, the heavy bag, given its inherently weighty nature, requires a very sturdy beam on a ceiling from which to be fixed and hung. An inbuilt disadvantage common to all three aforementioned apparatuses is the need for separate, specialized stand or mounting structures to be implemented to accommodate the installation of each apparatus. In addition to each requiring a dedicated floor area, such specialized mounting structures add to the installation time and cost of said apparatuses.

A second shortcoming, related to the first, pertains to the higher cost of installation itself. Just as mount structures and materials drive up the cost of each training apparatus, the more complex installation requirements of each design increases the total cost of owning the product. Very often, both of these—structural components and attendant installation costs—go hand in hand, with increased costs contributing to making the apparatus not only more expensive, but in certain scenarios prohibitively so.

A third shortcoming concerns significant constraints on the degrees of freedom for each of said apparatuses. The inventor has observed that said apparatuses, even once properly installed, operate about fixed and rather limited ranges of motions; accordingly, this limits the scope of possible training movements that each respective apparatus offers to athletes. For example, the speed ball, being very closely attached to the swivel mechanism of its required platform, is limited in its horizontal variance to a radius of less than twelve inches (30 cm), with practically no vertical variance. It enlists the athlete's reflexes but does not provide an intensive cardiovascular workout. Conversely, the double-ended ball/bag may offer greater horizontal variance than the speed ball/bag; however, it too provides little vertical variance. For its part, the heavy bag, owing to its large size and weight, provides a slightly greater cardiovascular workout but barely moves as a target and accordingly provides little in the way of reflex training.

A fourth shortcoming concerns the quality of training routines typically experienced using the aforementioned categories of apparatuses. As a result of the limited variation in their movement just described, athletes training with any of said apparatuses invariably experience particularly monotonous exercise sessions within only a few minutes of use. Here, a parallel to running on a treadmill may be made, with such experiences being viewed as not particularly engaging, lacking stimulation, or considered altogether boring for many athletes. Such lack of engagement often directly mars the enjoyment of the training routine often with repercussions on the perceived sense of achievement as well as the objective success of the athlete.

SUMMARY

Applicant has discovered that a boxing or martial art exercise regime involving the reflexes required using a speed bag and the aerobic stamina required of a heavy bag may be combined using a ball with selected characteristics of weight and rebound properties (including fist-to-ball compressibility) so that it can be struck into motion against a wall with a bounce sufficient to have a recoil to be hit again repeatedly while not losing control over the ball.

Accordingly, an object of embodiments presented herein is to provide a boxing/martial art training system to achieve the objectives of an engaging exercise presenting a variety of motion with minimal equipment setup or installation costs. Such embodiments achieve said object by combining aerobic exercises with reflex training through a properly crafted training ball 10 whose physical parameters are optimally selected to harmonize with the training level and objectives of an athlete. Embodiments of the ball 10 provide an athlete with stimulating exercise unrestricted to a single type of movement. Said exercise consists of variations resulting from an athlete's movements endeavoring to repeatedly strike said ball against a walled surface 20. In particular, said athlete endeavors to keep said ball in motion for an extended period of time, said motion being accomplished with any variation of physical actions, including upward-thrusting boxing punches, knee strikes or kicks. Furthermore, unlike the three broad prior art apparatus categories contemplated, embodiments described herein require that no overhead installation costs be contemplated whatsoever. Indeed, the portable nature of embodiments eliminates the reliance upon additional individuals to configure or otherwise enable trainings.

In accordance with a first aspect, embodiments for a spherical punching ball 10 that is unattached to any stationary object or structure are contemplated. This however does not preclude embodiments that may accommodate the use of a tethering setup, such as with an elastic or non-elastic cord, hanging from the ceiling and used as a training aid attachment to said punching ball.

In accordance with a second aspect, embodiments for a spherical punching ball 10 purposely designed for striking against a wall, said ball having weight, rebound speed, and density parameters optimized (i.e. structured) for specific target training difficulty and intensity are presented. Accordingly, elements of training routines variously emphasizing agility and strength are presented, with the athlete standing between approximately 2 feet and 4 feet (0.6 m and 1.2 m) from a wall, using fists to strike the ball repeatedly against the wall.

In accordance with a third aspect, embodiments for a spherical punching ball 10 of varying sizes (diameters approximately 15 to 25 cm/6" to 10"), weight (approximately 453 g to 1134 g/1 lb to 2.5 lbs), rebound characteristics (slow, moderate, and fast) and density (soft, firm, and hard), to accommodate the varying strength and skill levels (beginner, intermediate and advanced) for athletes are presented. It will be appreciated that compressible padding 300 can be provided between a knuckle portion of the gloves 30 and an outer wall of the ball to cushion an impact on a fist during the continuous striking of the ball, whether this compressible padding is part of the gloves, part of the outer surface of the ball, or both.

In accordance with a fourth aspect, embodiments for a spherical punching ball 10 constructed using layers of materials, each layer having a specific parameters to achieve the various embodiments contemplated in the third aspect, is presented.

In accordance with a fifth aspect of embodiments presented herein, the use of a properly crafted training ball 10 to meet the objectives contemplated above in combination with simultaneously wearing appropriate protective gear is contemplated. Specifically, protective gear in the form of exercise gloves (or other hand gear) and/or footgear crafted to avoid causing injury or soreness to the athlete during training is envisioned.

In accordance with a sixth aspect of embodiments presented herein, variations in the permutations by which various protective gear 30 and training ball are distributed are contemplated.

In accordance with a seventh aspect of embodiments presented herein, the ball is structured to have a surface with a greater compressibility than a single outer wall inflated ball having similar bounce and weight characteristics, and the ball is structured to provide good pressure distribution over a first when punched and good directional control when punched.

It will be appreciated that in some embodiments, there is provided a method of manufacturing a punching ball using a plurality of materials for continuous striking and rebounding against a wall 20 for the purpose of exercise and/or training various punching techniques, for example involving the methods as described herein.

BRIEF DESCRIPTION OF THE DRAWINGS

The invention will be better understood by way of the following detailed description of embodiments of the invention with reference to the appended drawings, in which.

DETAILED DESCRIPTION

Targets for training goals as well as related installation requirements for various types of exercise equipment contemplated herein are enumerated in the table below. A comparison of various properties and characteristics of a wall punching ball with the three most popular and standard punching bag/ball designs is provided.

| Equipment | Speed training | Strength straining | Accuracy training (hand-eye coordi-nation) | Intensive cardio-vascular training | Installation requirements |
|---|---|---|---|---|---|
| speed bag | yes | yes (limited) | yes (limited) | yes (limited) | Speed bag platform with swivel mechanism or a specialized speed bag stand |
| double ended bag | yes | yes (limited) | yes (limited) | yes (limited) | Sturdy floor and ceiling hooks or a specialized double ended bag stand |
| heavy bag | no | yes | no | yes | Very secure and sturdy wooden beam - heavy bag hanger or a specialized heavy bag stand. |
| wall punching ball | yes | yes | yes | yes | a solid wall |

Figure 1A:
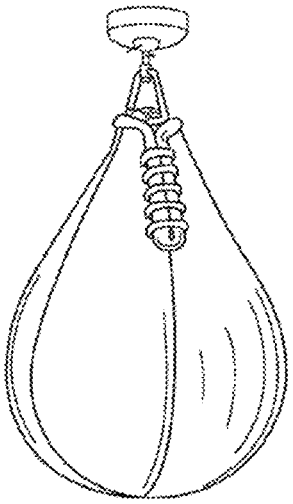
Figure 1a prior art
FIG. 1*a* depicts a sketch of a speed ball/bag as known from the prior art.
Figure 1B:
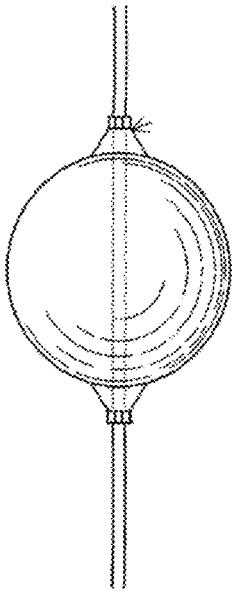
Figure 1b prior art
FIG. 1*b* depicts a sketch of a double-end ball/bag as known from the prior art.
Figure 1C:
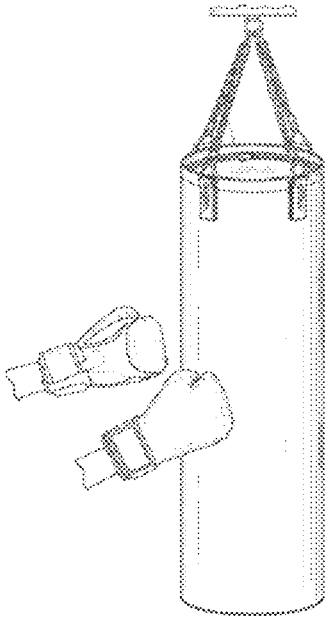
Figure 1c prior art
FIG. 1*c* depicts a sketch of a heavy bag as known from the prior art.
Figure 2:
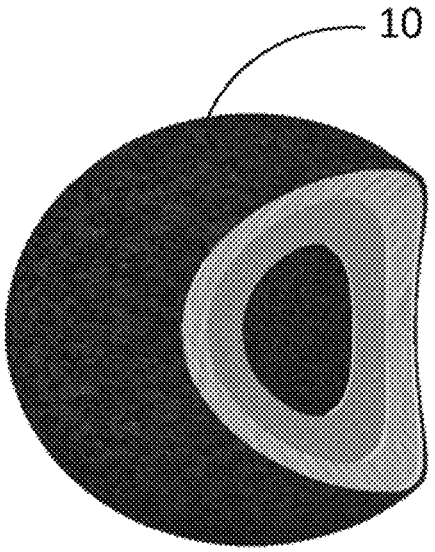
FIG. 2 shows a cross-section of an embodiment having a solid core design.
Figure 4:
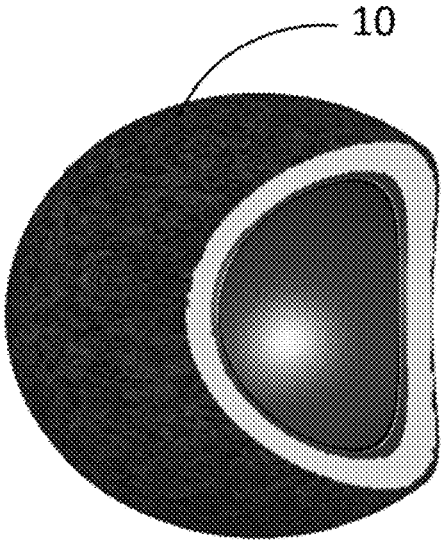
FIG. 4 shows a cross-section of an embodiment having an air bladder core.
Figure 10:
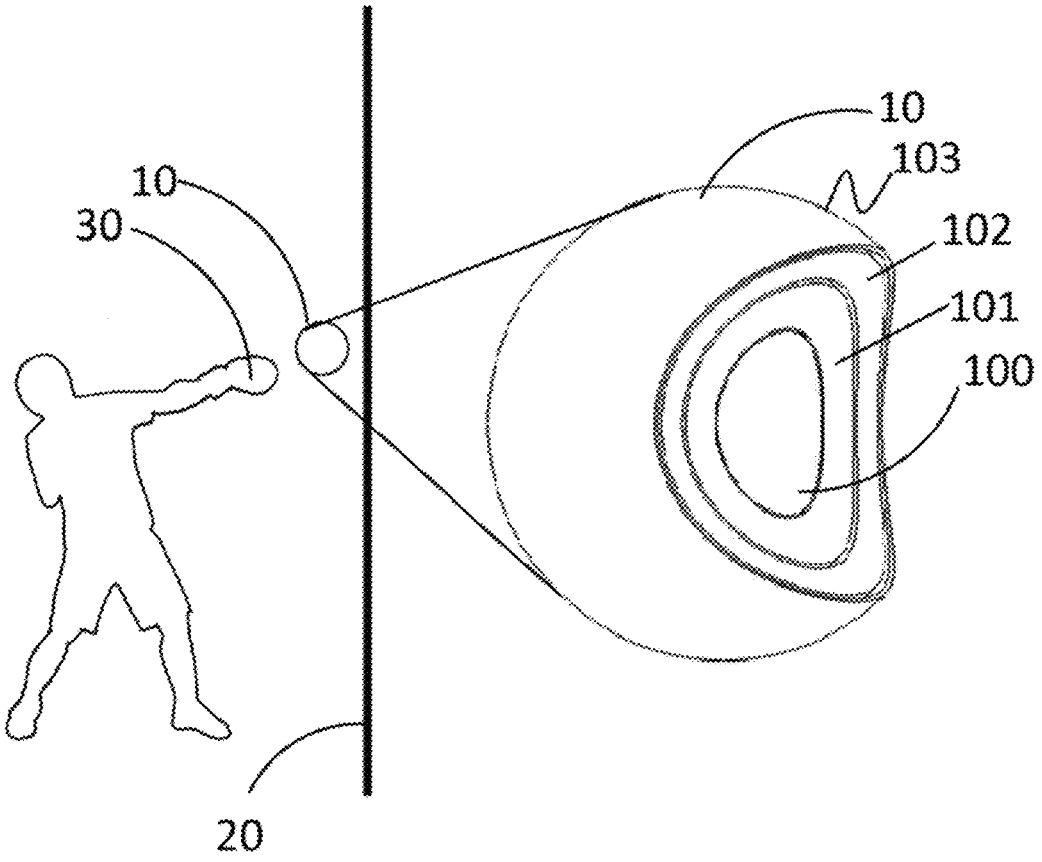
FIG. 10 depicts a silhouetted sketch of a method of training using an embodiment of the exercise ball to deliver a jab punch with a magnified cross-section of an embodiment having a solid core design.

With reference to FIG. 2 and FIG. 4, a boxing/martial arts training ball 10 to perform an engaging exercise presenting a variety of motion with minimal equipment setup or installation costs (FIG. 10) is described. As will be further described herein, an aim of training using embodiments is to ensure that the pace of exercise undertaken by an athlete using any one or more embodiments is compatible with both said athlete's target training goals and physical capabilities. Such compatibility may be realized and maintained through the incremental variation of certain physical properties and/or characteristics for embodiments of said ball, as will be discussed herein. Varying said characteristics may variously facilitate, render more challenging, or otherwise optimize said coordination and matching.

The wall punching ball 10 is specifically and purposely designed for striking against a wall 20 with weight, rebound characteristics, and density parameters, optimized (i.e. structured) for specific target training difficulty and intensity. The following table proposes a possible approximate size/weight design target chart:

| Skill level | Size category | Diameter | Weight | Speed | Density |
|---|---|---|---|---|---|
| Beginner | Large | 9" to 10"/ 22.9 cm to 25.4 cm | 1.0 lbs/ 0.45 kg | Slow | Soft |
| Intermediate | Medium | 8" to 9"/ 20.3 cm to 22.9 cm | 1.5 lbs/ 0.68 kg | Moderate | Firm |
| Advanced | Small | 6" to 8"/ 15.2 cm to 20.3 cm | 2.5 lbs/ 1.14 kg | Fast | Hard |

The following tracking data was collected from a wireless pulse monitor from the same subject on three separate occasions.

| Subject age 45<br>Subject weight 140 lbs/63.56 kg | | | |
|---|---|---|---|
| | Trial 1 | Trial2 | Trial 3 |
| Duration (mm:ss) | 43:59 | 41:43 | 42:16 |
| Average beats/minute | 142 | 138 | 141 |
| Maximum beats/minute | 171 | 171 | 169 |
| Calories burned | 492 | 446 | 483 |
| Fat calories burned | 178 | 167 | 176 |
| Fat (%) | 36 | 37 | 37 |
| Carbohydrates (%) | 64 | 63 | 63 |
| Ball weight (g) | 650 | 650 | 650 |

The appropriateness of embodiments of the present invention may be appreciated as a function of how adequately said embodiment enables an athlete to meet his or her training objective(s). While the relative fitness of an athlete—including, without limitation, strength, agility, and size—accounts for one broad component of objective-setting, certain physical ball parameters may likewise be viewed as a necessary counterpart. Parameters of interest in the latter category include, without limitation, ball mass, size, elasticity and restitution (or rebound) characteristics. It will be further appreciated that each of such parameters may in embodiments be varied with a view to level-matching correlation, that is, to achieve the required balance between physical ball parameters on the one hand, and the athlete's fitness ability, and training goals, on the other. Such level-matching is likewise instrumental to minimize or avoid injury.

For example, a correlation between the weight of an embodiment of the invention and the strength of an athlete will be appreciated. An embodiment with a mass under 500 g might be too light for a particular athlete and provide her with insufficient strength training, whereas one above 1 kg would be too heavy and would potentially lead to injury within short order.

Likewise, an embodiment with a diameter inappropriately sized with respect to an athlete's dexterity may variously result in a series of difficulties. In this context, a ball sized too small would demand a much finer level of motor skill than a beginner might yet possess to be kept aloft, whereas a ball too large may deprive a more seasoned athlete of the dexterity training he might otherwise obtain from a similar exercise but with a smaller-diameter embodiment. Additionally, forcing a single dexterity level onto all users of all embodiments, irrespective of any other consideration and particularly without varying any other parameters discussed herein, would significantly impair level training. While most embodiments contemplated are roughly volleyball-sized, it is appreciated that embodiments having wider variation in size may be desirable inasmuch as they provide useful variation in training.

In a related manner, attention is directed toward the elasticity and restitution characteristics of embodiments. Consistent with the notion of level-matching appropriateness discussed herein, embodiments having the bounce properties attuned with the capabilities of the athlete handling said embodiments may be important. Thus, an athlete attempting to clumsily manipulate an embodiment with outsized bounce properties may be more likely to lose control of the ball 10. Awkwardly pursuing an errant ball as it rolls away from said athlete's immediate exercise area may in various scenarios undermine the continuity of the exercise; it may likewise constitute an inconvenience or even a safety hazard for the athlete and other individuals in the vicinity of training. In an analogous manner, an embodiment whose bounce characteristics are undersized, when used by an athlete having comparatively greater strength and dexterity, may lead to increased stress on an advanced athlete. For instance, the latter athlete's knuckles may suffer injury due to the combined effects of a ball having lower bounce but greater weight, particularly when said athlete is habituated to a more rapid striking routine. It will be appreciated that both of these extremes run counter to the principle of level-matching described herein.

Weight and rebound characteristics of embodiments of the ball are discussed herein as being important elements to consider as part of a level-matched training routine. It will likewise be appreciated that the various parameters proper to embodiments of the ball as a whole are parameters that significantly influence said ball's response upon impact—whether against a wall 20 or when struck by an athlete's fist, knee, or foot. The physical response of the ball 10 as a whole is a result of the combined contribution of the physical characteristics of each of the various layers and materials that make up an embodiment, as well as any one or more cavities that the latter layers and materials define. At the same time, an important property governing an embodiment's overall behavior is the manner in which said embodiment's outermost layer responds to an impact (whether against an athlete's fist or a wall 20). The response of said outermost layers is quite significantly a function of the physical parameters resulting from the materials selected for the extremities of embodiments. Parameters such as foam type, foam density, thickness, and rebound parameters—and in particular the coefficient of restitution—play a significant role in this regard.

It will be noted that a ball constructed to have compressibility greater than that of one or more bladder-type balls known in the art is not typically suitable for purposes of embodiments contemplated herein. Likewise, many uniform density foam balls, even if they might provide the compressibility characteristics described herein, may potentially offer disproportionately elevated rebound characteristics. It will similarly be appreciated that attempting a sustained training routine as described herein using a ball largely lacking in said rebound characteristics would result in a painful and largely non-ideal experience. Applicant has determined that an ideal solution is one in which a hybrid of two or more materials, such as foams of varying densities, is implemented to define the various layers of an embodiment of the training ball.

The particular role of the coefficient of restitution as observed at the outermost layers of an embodiment may be appreciated by considering an example in which said outermost layers are (individually or collectively) of a comparatively hard or dense material. In particular, consideration is directed to scenarios where said material is of such extreme firmness that they do not allow the ball to yield (whether easily, perceptibly, or at all) to impact and particularly to human touch. When an athlete strikes a ball of such firmness, the ball's outermost layer does not momentarily compress even slightly. This can occur, for example, when the ball's outermost layer either is or immediately touches a layer of foam that does not compress. As a result, the outermost layer remains a relatively hard shell when struck. In such cases, said athlete's ability to direct the ball with her strike increases in difficulty quite substantially. This is because the ball impacts the athlete's bare fist without partially and momentarily conforming to said fist. The absence of such compressibility of the embodiment's outermost layer at both the point and moment of impact confers excessive rebound characteristics to the ball which in turn impair the athlete's ability to direct the ball with a strike. It will be appreciated that the effect of the foregoing is magnified for embodiments of the ball having greater weight. Exercising under such conditions presents disadvantages similar to performing the training routine described herein using a dangerously under-optimized rotationally molded ball, such as a very low-weight medicine ball. Training-related challenges resulting from such high-bounce and high-weight embodiments limited the latter's usability to all but the strongest and most agile athletes. The sustained nature of such embodiments' contact with the bare fists of an athlete under such circumstances also increases the likelihood of said athlete experiencing pain and, in more extreme cases, possible injury, particularly to the bones and muscles of the wrists and hands.

Applicant has determined that a lower coefficient of restitution at the outermost layers of embodiments of the ball 10 is desirable, even if the desired coefficient of restitution for the ball 10 as a whole (as resulting from underlying layers) may likewise be simultaneously desirable. The effect of such apparently counter posed choices for a physical parameter is such that when an athlete punches an embodiment of the ball, the part of his fist that makes contact with the ball produces a temporary impression upon the surface of said ball. The ability of an embodiment's outermost layer to temporarily absorb and match the shape of the athlete's fist—as enabled by the decreased coefficient of restitution—facilitates said athlete's ability to direct the ball 10 toward the wall 20. Likewise, the embodiment's relatively high coefficient of restitution confers ideal rebound characteristics upon the ball for repeated and more easily manageable strikes against a wall 20.

It will be appreciated that this counter posed selection of values for the same physical parameter as targeted toward different radial sections of the ball is important to implement the aforementioned such optimality. While the disadvantages of imposing a single coefficient of restitution whose value is inordinately high has been described previously, Applicant has likewise determined that imposing a uniform coefficient of restitution whose value is too low (such as by deflating or under inflating embodiments of the ball) is likewise undesirable as it results in reduced rebound characteristics overall, in addition to insufficiently firm contact with the ball 10. As a result, an optimal combination of the coefficients of restitution—higher in the center, slightly lower at the extremities—is necessary to produce an embodiment having both surface deformability and rebound characteristics overall that together allow that athlete to retain control of the ball 10 while it is aloft.

It will likewise be readily appreciated that the aforementioned discussion relating to benefits of said counter posed coefficients of restitution to fists is transferable, with the appropriate substitutions, to other methods of striking the ball, such as with the knee and foot.

It will be further appreciated that as a result of simultaneously varying multiple parameters for increased overall difficulty (such as weight and rebound characteristics), additional energy is required of the athlete to keep an embodiment aloft. To do so, said athlete must, as further described herein, typically strike said ball 10 to impart it with an upward trajectory having a comparatively greater angle with respect to the horizontal (i.e. more upward than toward the wall). Accordingly, if the weight of the ball is held constant across two embodiments but the rebound characteristics (e.g. greater coefficient of restitution) are increased for one of them, it will be appreciated that the embodiment with greater rebound capability is comparatively easier for an athlete to train with overall. As discussed herein, an increased coefficient of restitution contributes toward providing the athlete with an embodiment that is comparatively less physically stressful to strike and impart with upward momentum toward a wall 20, but also because an increased coefficient of restitution contributes toward creating a comparatively wider downward parabolic rebound trajectory from the wall 20 and back to the athlete that provides said athlete more favorable circumstances in which to reposition to strike the ball anew. Likewise, it will be appreciated that such increased angular striking capability, while certainly requiring more work for heavier embodiments, is facilitated to a degree with increased rebound characteristics.

A simplified production and marketing scheme in a series of embodiments may comprise having a limited number of balls (e.g. three), each with different weights, and wherein ball bounce characteristics increase, compounded with successively heavier embodiments of the offered product line. In this way, a single product progression simultaneously combining multiple characteristics begins with an embodiment broadly targeting beginners, one or more intermediate embodiments, and a final superlative embodiment combining a selection of said characteristics to present the greatest challenge to an athlete with respect to said product line. Such a strategy may be desirable in cases where it is desired to limit the number of models to produce.

In a related series of embodiments, it may be desirable to organize said embodiments into a product line or matrix comprising a finite number of variants (e.g. between 3 and 5) for physical parameters with a view to both provide greater variability and more optimal targeting of specific elements of a workout routine (e.g. strength, motor skill, etc.). In another series of embodiments, additional variants may allow for a more complex combination of said parameters.

EXAMPLE EMBODIMENTS

A selection of possible embodiments is described with a view to elucidate such design parameters as weight, rebound characteristics and density requirements of the said punching ball 10. It will be appreciated that additional variants not explicitly enumerated and described may also be contemplated without deviating from the spirit of the matter described herein.

Example 1: Solid Core Embodiment

Figure 3:
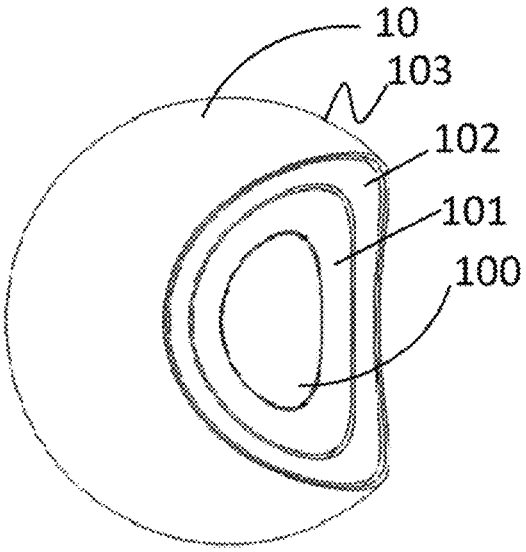
FIG. 3 shows a cross-section of an embodiment having a solid core design, with particular emphasis on the various layers within said embodiment.

With reference to FIG. 2 and FIG. 3, solid-core embodiments are contemplated, comprising layers of different types of foams, each with varying weight and rebound properties. It will be appreciated that the types of foam used in the manufacture of said embodiments, as well of the proportion thereof—depend on various characteristics desired and which must be imparted to said embodiment. Such characteristics include, in a non-limiting enumeration, weight, rebound speed, spring characteristics, and density. Such aforementioned foam layers are successively wrapped about a weighty spherical material, rubber- or gel-like material, located in embodiments approximately at the geometric center of said ball. An outer shell coats the foregoing, said shell being made variously of genuine or synthetic leather bound using heavy-duty stitching.

FIG. 2 shows a cross section diagram of a solid core design. FIG. 3 shows a wire frame model of a similar cross section, with additional emphasis on the various layers making up said ball. A solid core 100 is typically located in the geometric center of embodiments of this type. As discussed previously, this core 100 may be made of rubber, polyurethane gel or another weighted spherical material, namely to provide a spherical structural definition to an embodiment. A main purpose of this part 100 is to add weight to the embodiment while contributing to the total rebound characteristics of the ball at high compression. As a result, materials with which the core 100 may be manufactured should be ideally selected to result in the best rebound characteristics, namely highest coefficient of restitution.

During athletic training (FIG. 10), further discussed herein, the aforementioned compression is supplied via upper medium to maximum force, typically by way of an athlete throwing a hook punch or straight punch. The athlete is typically a meter or more away from the wall 20 in cases where the ball is struck in this manner.

The first layer 101 surrounding the core 100 is typically made of high density foam. In an embodiment, such foam may be polyurethane, and typically have a density relatively greater than that contemplated for the next level of foam 102 discussed subsequently. This layer 102 is involved in imparting rebound characteristics to embodiments of this type at moderate compression. It is also responsible for the soft feel of the ball as well as for initial cushioning upon impact with the athlete's fists.

An athlete typically imparts such compression by way of lighter to medium force on the ball. Such force is typically delivered by the athlete typically located within a meter of the wall 20 by way of jab punches, light elbow strikes, and uppercuts.

Light-to-medium density foam is typically employed for the next layer 102. As before 101, lower density polyurethane may be contemplated for manufacture of this layer 102 for embodiments currently described. A lower coefficient of restitution is to be targeted for this layer as well, as it is likewise responsible for the soft feel of the ball and initial cushioning for the athlete's fists.

Finally, various materials known or valued for their use in providing shell material and functionality for a sports ball may be contemplated for the outer shell 103 of embodiments currently described. Said outer shell 103 provides for basic protection of the ball. Various forms of leather and synthetic leather are contemplated for this purpose. Accordingly, leather is contemplated as a first choice for this purpose, as a result of its durability and preeminence as a luxury material. It is particularly well-suited to professional use, and for embodiments intended to be bounced against smoother walls 20. It will be appreciated that the smoothness of the walls plays a preventive role in minimizing scratching of the outer shell 103 leather surface.

Likewise, leather is known to be more resilient to tearing than microfiber. However, microfiber may be contemplated in various embodiments and sought for its lower price relative to leather. Likewise, the lower price of microfiber may appeal to a more price-sensitive market segment, as its use would contribute toward a lowering of cost for the entire embodiment. Likewise, its comparative durability over leather is an advantage, as well as its comparatively greater resilience to scratches. Such resilience renders embodiments so made particularly suited for use against walls made of more abrasive materials (e.g. bricks).

Likewise, it will be appreciated that different materials for use with the outer shell 103 may affect the overall performance of embodiment, including but not limited to such considerations as friction factors. Other manufacturing requirements, aesthetic considerations, client and/or market preferences may likewise govern the patterns and stitching styles of an embodiment's outer shell 103.

Example 2: Air Bladder Core Embodiment

With reference to FIG. 3 and FIG. 4, air-bladder core embodiments are contemplated, comprising the use of an air-filled chamber or "bladder" in conjunction with other layering materials. In a non-limiting enumeration, said layering materials may include foams, rubber, polyurethane gel, and cotton padding. It will be appreciated that such bladder or layering materials to use in an embodiment depend on such factors as weight, rebound speed, spring characteristics, and firmness desired. Additionally, an air inlet nipple should be installed to allow adjustment of air pressure in the air bladder, which can be used to adjust the total density and rebound characteristics of the ball. In a manner analogous to that contemplated for a solid core embodiment described herein, an outer shell having genuine or synthetic leather with heavy-duty stitching may likewise be contemplated for air bladder embodiments.

Figure 5:
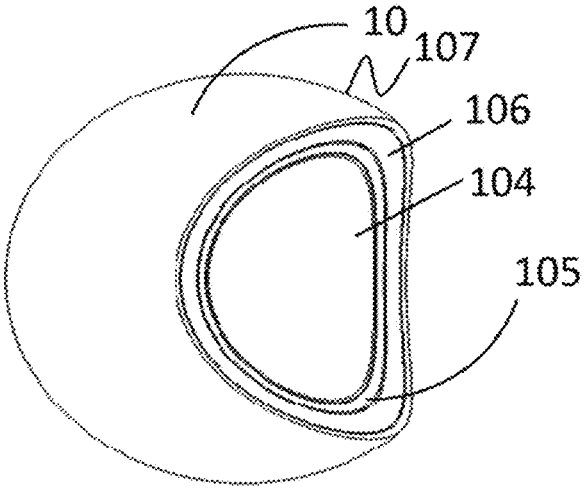
FIG. 5 shows a cross-section of an embodiment having an air bladder core, with particular emphasis on the various layers within said embodiment.

FIG. 4 shows a cross section diagram of an air bladder core design. FIG. 5 shows a wire frame model of a similar cross section, with additional emphasis on the various layers making up said ball.

A rubber air chamber or bladder 104 is defined at the geometric center of such embodiments. In an embodiment, an inlet nipple or similar regulating mechanism may be present to regulate the air pressure inside said embodiment. It will be appreciated that addition of air to this part 104 of the ball, typically by way of said regulating mechanism, will contribute toward increasing rebound characteristics of the embodiment overall, the effects such increase being further discussed herein. One key result of such increased rebound characteristics is the corresponding adjustment in the speed at which various training exercises may be attempted with the embodiments.

It will be appreciated that the volume of the air bladder for any such embodiment must be finite. A means by which to both delimit the volume and constrain the expansion of the air core 104 is implemented by an enveloping layer known as a bladder expansion constraint 105. A woven material is typically used to implement this expansion constraint 105.

A polyurethane gel layer 106 surrounds the expansion constraint 105 and contributes toward characterizing both the overall behavior as well as the mechanical and viscoelastic response of embodiments of the ball in a manner analogous to the polyurethane foam contemplated in Example 1. The air chamber 104 design provides for material cost advantages over the solid core component 100 design, in addition to enabling series of embodiments with a greater rebound characteristics adjustability post-manufacture than Example 1. However, the absence of a solid core component 100 in such embodiments (FIG. 4, FIG. 5) presents design challenges relating to the structure of the ball. It will be appreciated that imparting a firm form to embodiments is a necessary element of design and manufacture. Accordingly, use of polyurethane gel provides the ball with firm structural definition for this purpose and particularly in the absence of a solid core component. Said gel likewise contributes toward the maintenance of embodiments' structural integrity during use, as well as providing the physical response sought.

The outer shell 107, in a manner analogous to the outer shell 103 of the previous example embodiments, may likewise be made of leather, synthetic leather shell or any other material that would offer the same outer-shell functionality. Once again, pattern and stitching styles contemplated for the outer shell 107 may depend on aesthetic factors and/or manufacturing considerations.

Figure 7:
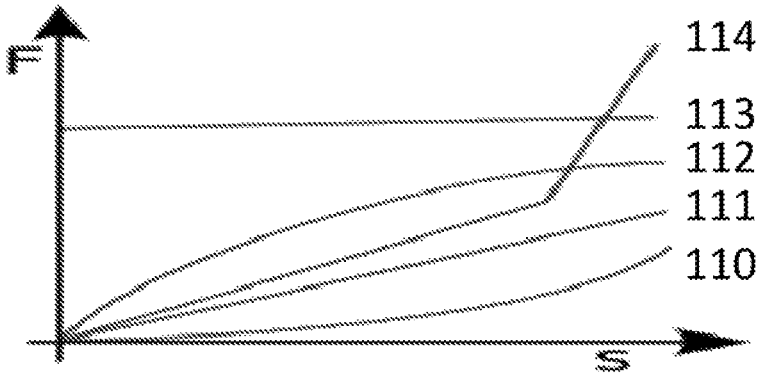
FIG. 7 shows plots of various possible spring-like characteristics, classified depending on the manner in which load force is applied to an embodiment.

Rebound characteristics for embodiments described herein may be patterned after and follow known spring characteristics (FIG. 7), namely progressive 110, linear 111, degressive 112, almost constant 113, and progressive with knee 114.

Example 3: Embodiments with Training Aid Accommodation

It will be appreciated that various embodiments contemplated herein include a punching ball, a typical interaction with which comprises being struck repeatedly by an athlete against a wall. Embodiments of said ball may be entirely unattached or untethered to any stationary object or structure whatsoever. However, such contemplation should in no way be construed as limiting or otherwise precluding the contemplation of embodiments at variance with the notion of an untethered training ball. Specifically, embodiments which may conversely accommodate one or more mechanisms allowing for the attachment or connection of an elastic or non-elastic cord or cord-like material to one or more points on the training ball may be contemplated. Embodiments so constrainable may likewise be tethered to or hanging from the ceiling or some other structure. Such tethering embodiments may be particularly desirable, for example, for use by entry-level users requiring specific coordination and dexterity training. Training aid embodiments may be distinctly manufactured and commercialized as standalone variants with respect to other non-training aid embodiments. Training aid embodiments may likewise include mechanisms, features, and/or other implements (such as clasps or securing means) to optionally attach or remove rope and/or other tethering implements. Portions of such implements may be built into embodiments of the training ball itself, said training ball being structured to adapt to or be adaptable for use with such training aids. Accordingly, tethering implements may non-limitingly include notches, clamps, hooks, or grooves to cooperate with rope or other fastening means, supply, or source. Use of multiple implements and mechanisms at a time may be envisioned as well. In related embodiments, early stage tethering implements may be removed from said adaptable embodiments once they are no longer needed by an athlete to yield a variant largely similar in function, use, physical characteristics, and appearance to other embodiments unconcerned with said training aids. Thus, training aid embodiments may be envisioned either for temporary use or to temporarily remain as such.

Example 4—Moulded One-Piece Design

Particularly robust embodiments are likewise envisioned for use in extreme environments involving walls having particularly rough textures, components, or elements (such as spikes or other architectural elements) which may severely damage other embodiments contemplated herein. Such robust embodiments may be manufactured to optimize durability and require no pump or additional user involvement to inflate. They may likewise be designed to mitigate or altogether resist air loss despite perforation. Such embodiments may be made from desirable combinations of molded rubber and/or foam to confer quasi-indestructible qualities to the ball so that its use under even the most extreme weather conditions (hot, cold, wet, or dry) does not impair continued use.

Other Possible Embodiments

It will be appreciated that the embodiments discussed heretofore should not in any way be understood as being of deliberately limited or circumscribed scope. Accordingly, additional possible embodiments are envisioned. These include design options and related considerations. Scenarios may for example call for simplification in design, including but not limited to less layering of different materials. Such simplifications may likewise go hand in hand with any considerations or stated targets relating to embodiments' weight, size, rebound characteristics, density, and manufacturing cost. Alternatively, more complex designs with more intricate layering of different materials may be contemplated should any one or more of the weight, size, rebound characteristics, density, and performance targets require it.

Training Method

With reference to FIG. 6*a* through FIG. 6*l*, an exercise and training method by an athlete using embodiments described herein will be discussed. Although the term "athlete" is most frequently encountered herein, it will be appreciated that variations on the type of user training with said embodiments may be envisioned. Such variations include, without limitation, boxers, fighters, trainers, or any other actor. Similarly, it will be appreciated that unless explicitly specified to the contrary herein, embodiments discussed or presented using one or another gender may be understood to be usable by and targeted to both male and female users.

Figure 6A:
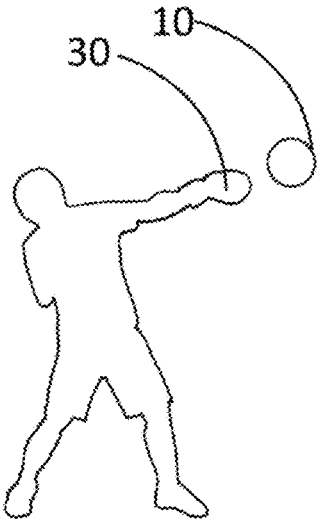
FIG. 6*a* depicts a silhouetted sketch of a method of training using an embodiment of the exercise ball to deliver a jab punch.
Figure 6B:
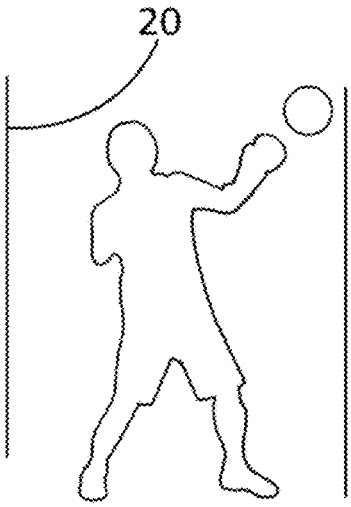
FIG. 6*b* depicts a silhouetted sketch of a method of training using an embodiment of the exercise ball to deliver a high straight punch.
Figure 6C:
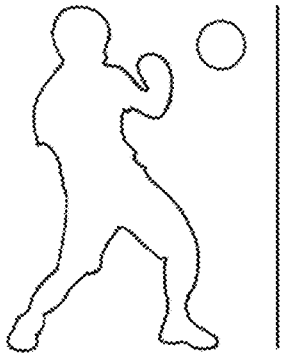
FIG. 6*c* depicts a silhouetted sketch of a method of training using an embodiment of the exercise ball to deliver a left hook punch.
Figure 6D:
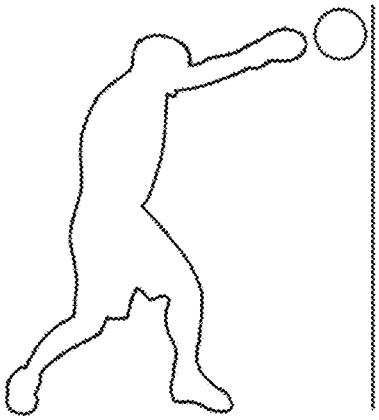
FIG. 6*d* depicts a silhouetted sketch of a method of training using an embodiment of the exercise ball to deliver a straight right punch.
Figure 6E:
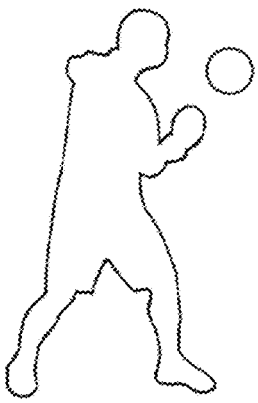
FIG. 6*e* depicts a silhouetted sketch of a method of training using an embodiment of the exercise ball to deliver an uppercut punch.
Figure 6F:
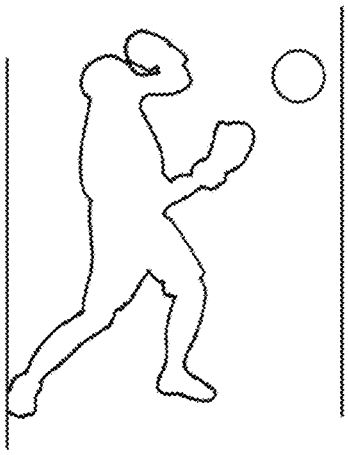
FIG. 6*f* depicts a silhouetted sketch of a method of training using an embodiment of the exercise ball to deliver a right uppercut punch.
Figure 6G:
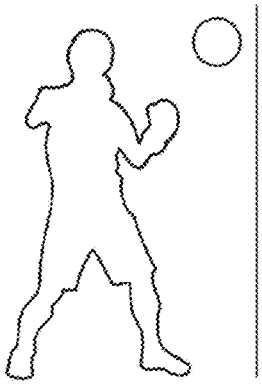
FIG. 6*g* depicts a silhouetted sketch of a method of training using an embodiment of the exercise ball to deliver a left uppercut punch.
Figure 6H:
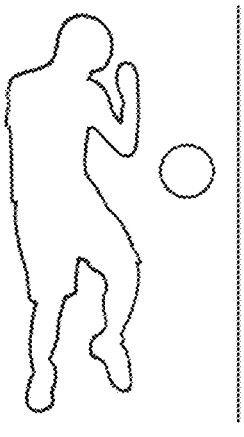
FIG. 6*h* depicts a silhouetted sketch of a method of training using an embodiment of the exercise ball to deliver a thigh strike.

A training session typically begins with an athlete standing approximately 3 feet to 4 feet (1.0 m to 1.2 m) from a wall (FIG. 6*a*). The athlete typically faces the wall with a stance allowing said athlete to quickly move toward and away from the wall.

The stance shown in FIG. 6*a* depicts the athlete having one foot in front of the other to facilitate such forward and backward movements. The athlete uses fists and other parts of his anatomy (such as knees and elbows) to strike embodiments toward the wall. Following impact with the wall, the ball rebounds. It is an objective of the athlete to respond to such rebounding by striking the ball once again in a manner to keep it aloft, typically for an extended duration. Athlete's response may include alternating fists as well as whole body movement to be positioned (and/or repositioned) for subsequent strikes. Said duration may be a determined or prespecified target; alternatively, the duration may remain unspecified and depend on other factors such as endurance alone.

Also, as a result of variability introduced by ball-wall deflection possibilities, the method of training typically offers significant vertical and horizontal variation in ball movement (and correspondingly, dexterity training for an athlete to target the ball and keep it aloft). This is particularly the case for embodiments in which said punching ball is not physically attached to any other object or structure. The randomness of the deflection angles and corresponding reflected ball trajectories introduced as a result of this training process likewise better mimics a live, moving opponent, as in boxing or sparring.

Training with embodiments of said punching ball can also develop the athlete's shoulder muscles and improve reflexes and response. Fast twitch muscles are developed by engaging in exercises that involve speed, explosiveness, and require short reaction time. Embodiments of said punching ball force the use of these physical traits by harnessing an athlete's ability to quickly apply dexterity and strength.

With particular reference to FIG. 6*b*, FIG. 6*c*, FIG. 6*e*, FIG. 6*g*, and FIG. 6*l*, standing near the wall (approximately 2 feet (0.6 m)), and with some practice, the athlete may learn to use said punching ball to train for hand, speed, and eye coordination. He may achieve these by controlling an embodiment of the ball by using short, compact strokes. These require not that the athlete strike said embodiment quickly, but rather that he keep it in motion and aloft. It should be noted that the purpose of such motions is to emphasize athlete focus on increasing speed with a view to gaining agility or control over the ball, as opposed to power or strength.

Stepping further away from the wall (about 3 feet (1 m) or more), and with reference to FIG. 6*a*, FIG. 6*d*, FIG. 6*f*, and FIG. 6*h*, the athlete may strike an embodiment harder to impart greater acceleration to the ball. Following impact with the wall, such increased acceleration causes the ball to bounce back with even greater velocity. Force being defined as the product of mass and acceleration, the amplifying chain of events just described requires that the athlete strike the ball, now having greater acceleration, with greater force for said ball to strike the wall and bounce back again.

Figure 6I:
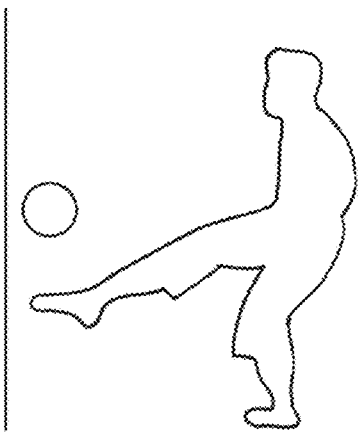
FIG. 6*i* depicts a silhouetted sketch of a method of training using an embodiment of the exercise ball to deliver a low kick.
Figure 6J:
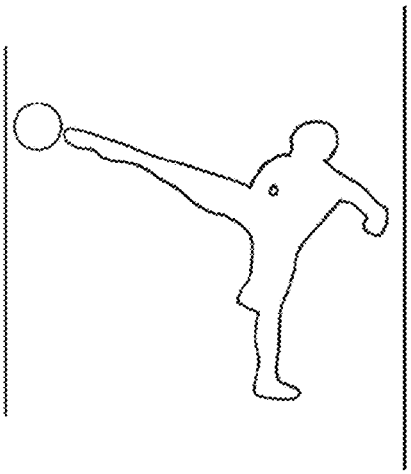
FIG. 6*j* depicts a silhouetted sketch of a method of training using an embodiment of the exercise ball to deliver a high kick.
Figure 6K:
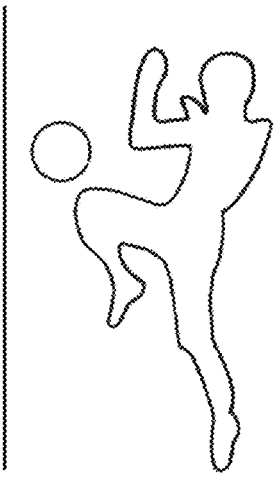
FIG. 6*k* depicts a silhouetted sketch of a method of training using an embodiment of the exercise ball to deliver a knee strike.
Figure 6L:
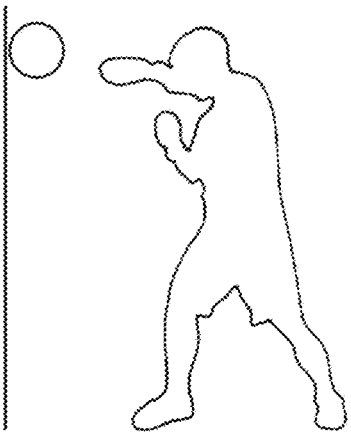
FIG. 6*l* depicts a silhouetted sketch of a method of training using an embodiment of the exercise ball to deliver a straight left punch.

While a significant proportion of the discussion herein involving interaction with embodiments emphasizes training methods using fists, an athlete may choose to additionally incorporate into his or her training method the use of additional anatomy. FIG. 6*i*, FIG. 6*j*, and FIG. 6*k* Illustrate possible ways in which the use of legs—and specifically knees and feet—may be incorporated into a training routine. It will be appreciated that, with the necessary conceptual modifications, certain considerations due to angles and force discussed herein may be applied.

It will be appreciated that a slightly larger embodiment of said punching ball having greater weight may also share training elements in common with a heavy bag. However, a very important distinction is that embodiments provide much greater vertical and horizontal target position variation as further discussed herein.

Likewise, it will be further appreciated that the challenges inherent to maintaining embodiments aloft, in addition to the athlete sustaining a steady striking rhythm, all while maintaining in "play", rhythm, and in good overall form during training provide a measure of additional enjoyment, or extra bit of fun factor (namely cognitively stimulating) to ensure that training remains interesting, engaging. The potential randomness (namely, large variability) in ball movement often presents an athlete with having to strike a ball with a wide range unexpected angles and forms. This wide range of movement realistically parallels being faced with a live opponent prone to randomly changing position while executing offensive or defensive tactics.

Despite the fact that in many embodiments, the punching ball is detached from any fixed structure such as a wall, a ceiling, a floor, or any other specialized equipment, stand or apparatus, it is constantly affected by gravity. As a result, the aforementioned embodiments would have to be struck by the athlete facing the wall with some positive angle relative to the horizontal parallel to the ground, said angle being sufficient not only to bounce against the wall but also to offset the effect of gravity on the ball. This angle is perhaps best illustrated in FIG. 6*b*, FIG. 6*e*, and FIG. 6*g*. The range of values for this angle is dependent on two factors, namely velocity and distance. Velocity is the speed at which an embodiment strikes the wall, which is determined by the force of the punch applied to the ball. Distance is a numerical description of the length describing how far the athlete is from the wall. The effect of velocity and distance on the required angle is as follows. Holding ball velocity constant, the shorter the distance between the athlete and the wall, the smaller the positive angle with respect to the horizontal required for an embodiment to sufficiently overcome the effect of gravity. Accordingly, if the distance between the athlete and the wall is held constant, the faster the speed at which the ball is made to travel (such as by applying more forceful punch) the smaller horizontal angle required for the ball to sufficiently overcome the effect of gravity. This speed-distance correlation to angle adjustments somewhat intuitive to most athletes, including novice users, and as demonstrated variously in FIGS. 7*a* through 7*l*.

It will be appreciated that the aforementioned gravitational effects would be decidedly mitigated for certain embodiments. In particular, such embodiments are those in which the punching ball is combined with an optional elastic or non-elastic cord used as a training aid by which the punching ball is attached or hung to the ceiling or some other structure.

Notwithstanding the latter mitigated exception, a relationship between angle, distance, and velocity may be expressed. Such a gravitational consideration formula expressed as a proportionality may be expressed as angle-∝distance/velocity. This proportionality relationship does not purport to represent any specific units of measurement, but merely provide a representation of the interdependency of angle, distance and velocity when using embodiments of said punching ball.

The tracking data table presented earlier illustrates that embodiments enable exercise sessions that may provide athletes with significant physical training. The table further enumerates a plurality of data sets to demonstrate, among other elements, a connection between the weight of an embodiment, training time, calories burned and cardiovascular performance over an approximately 40-minute training interval. Collecting matrices of similar data for additional variables, accounting for variations in training intervals, ball weight, duration, and other more granular parameters such as muscle gain on various builds of athlete may likewise prove helpful in determining the equivalence of such training sessions with more monotonous traditional training routines with a view to replacing said traditional routines with more engaging ones using embodiments described herein.

It will likewise be appreciated that one or more variants of the aforementioned training routine may be contemplated. In said variants, two or more athletes may engage in various collaborative variations of the training method described herein.

Construction of Example Embodiment 1

A solid core embodiment prototype was constructed for demonstration, testing and development purposes.

Materials

Said embodiment comprised the use of a standard softball for the core 100. A polyurethane foam ball having a circumference of 18.5 cm circumference was used for the subsequent (second) layer 101, with a dense sheet of 1.5 cm thick rebond foam (often used for carpet padding) was used for the third layer 102. A synthetic leather shell taken from a standard size volleyball having a circumference of 67 cm was used to create the fourth and final layer, known herein as the outer shell 103. Contact cement glue was used to bond the previous layers 100, 101, 102, 103. Black duct tape was likewise used for structural reinforcement, as was black spray paint specifically formulated for use with vinyl and fabric; the latter paint was suited for use with the synthetic leather shell fabric used to make the outer shell 103.

Construction and Assembly Procedure

Construction of the aforementioned prototype was begun by cutting the polyurethane foam ball in half. A portion in the center of the polyurethane foam ball was removed to make room for the softball. The softball was snugly fitted and glued (using the contact cement) at the center of the polyurethane foam ball. The two halves of the polyurethane foam ball were then glued together and the circumference was reinforced using duct tape.

The rebond foam was cut in four pieces each having an elliptical shape; this is a typical pattern for ball-shape crafting. The dimensions of these pieces were calculated to cover the entire surface of the aforementioned 18.5 cm polyurethane foam ball. The four piece elliptical shape rebond foam was subsequently glued to the polyurethane foam ball and left to dry for 24 hours.

The ball construction was then placed inside the volleyball synthetic leather shell and the opening previously cut was stitched closed, bound using a 10 lb (4.5 kg) nylon fishing line. The ball was then spray painted with black paint specifically formulated for vinyl and fabric and was left to dry for 24 hours. With the paint fully dried, the nylon stitching was reinforced with black Duck (or duct) tape.

Figure 8:
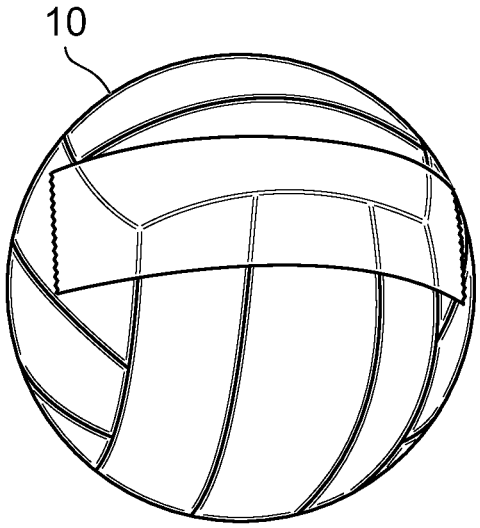
FIG. 8 depicts a completed solid core prototype constructed by hand.

The completed hand-built prototype (FIG. 8) has a circumference of 67 cm, and weighs 650 grams.

It will be appreciated that the aforementioned description is provided for documentary and suggestive purposes and is not intended as a single exemplary construction process. Rather, it is intended to inspire a more sophisticated design and manufacturing process likely on a far greater, industrial scale. Said process may likewise incorporate use of skills, assets, and materials known in the art and potentially more optimally suited to the target ends of various embodiments contemplated within. Relatedly, different aesthetic considerations may be applied to various embodiments without departing from the spirit and concrete principles described herein. Without limitation, these include the manufacture of embodiments having different colors and branding.

Wall Punching Ball Design Benefits

As described herein, embodiments are contemplated in comparison to three of the most popular and standard punching bag/ball designs known in the art.

It will be appreciated that embodiments solve problems related to installation complexity: said punching ball requires only a solid wall. In a very limited sense, such embodiments may be thought of as being akin to a speed ball but without the need for attachment means to a swivel mechanism, or like a double-ended bag without the need for elastic cords. Also in a narrower sense, larger and heavier embodiments may also share training elements in common with a heavy bag, without the significant support infrastructure required by the latter.

Likewise, this lack of mounting support structure for embodiments described herein as compared with a heavy bag and other known and contemplated devices solves (or at the very least attenuates) the higher cost of installation for other equipment known in the art. Embodiments herein typically lack installation requirements, with access to a wall 20 being a principal assumption required for most of said embodiments.

Thirdly, embodiments described herein solve the problem of limited variance in target movement. With many of said embodiments being physically unattached or unrestrained to any supporting structure, a much greater target position variance, namely, variation in ball rebound trajectories—both vertically and horizontally—is presented to and demanded of an athlete. Consequently, the athlete is forced (namely, incentivized) to acquire greater skill to maintain good form and uninterrupted rhythm. Such increased variation in target motion over the prior art randomness (namely, large variability) also closely mimics similar movements such as might be required with a live opponent, as in boxing.

Use of embodiments at two distances—one closer to the wall, and one farther—provides opportunities to athletes wishing to hone different but complementary skills.

Practicing striking (typically punching) embodiments closer to a wall (at a distance of approximately two feet or 0.6 m), with some practice, a fighter can learn to use said embodiments to train for speed as well as increased hand-eye coordination. This means that such practice fosters the development of greater skill for the athlete, who would likewise be forced to maintain both good form in his training technique in addition to uninterrupted rhythm.

Likewise, stepping further back from the wall (about 3 feet or a meter), provides the fighter with opportunities to increase strike force upon embodiments, resulting in the ball bouncing bounce back from the wall with greater velocity which in turn requires that the fighter strike the ball with greater force to make it bounce back against the wall. While the emphasis at this distance is on increased strength building, here too, the physical training challenges presented similarly provide the fighter with routines to foster maintenance of good form and uninterrupted rhythm. In this way, physical fatigue, as opposed to boredom, is a main factor in the conclusion of training with embodiments.

An often-overlooked element in many types of physical training concerns the monotony of training routines. In embodiments described herein, the need to keep the punching ball aloft (in "play"), maintaining rhythm and with proper form provides an athlete with an added stimulating challenge; this is combined with the increased randomness in ball movement and both on account of the athlete striking the ball and its rebound angles from the wall. Angles and manner (that is, trajectory) that are potentially unexpected by the athlete represent a realistic situation comparable to one in which he is faced with a live opponent (boxing or sparring, for example) who is likewise apt to randomly change position while executing an offensive or defensive tactic.

Hand Wraps and Gloves

Figure 9A:
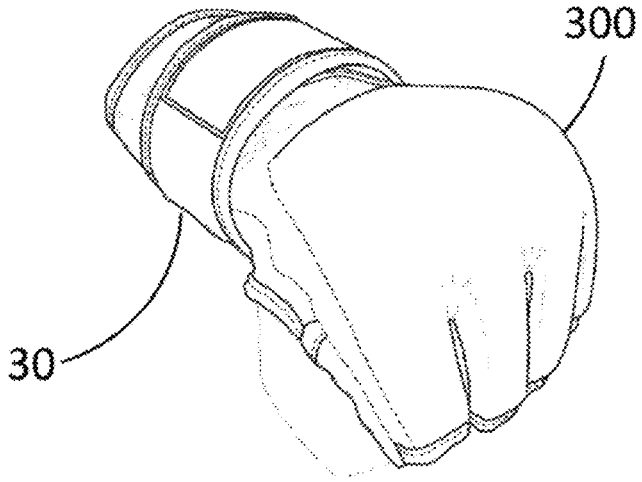
FIG. 9*a* depicts a frontal view of a training glove with a compressible material or padding over the knuckle area for absorbing blows.
Figure 9B:
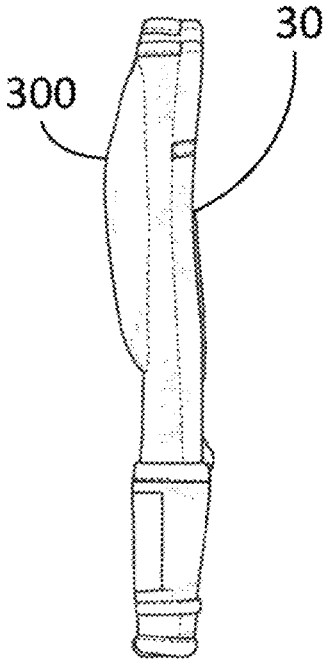
FIG. 9*b* depicts a side view of a training glove showing with a compressible material or padding over the knuckle area for absorbing blows.

It will be appreciated that the frequent striking action encountered while training with embodiments of the punching ball may lead to considerable sustained force being applied to both the wall and to the knuckles, fists, and joints of the athlete. In the course of such training, the use of hand-wrapping techniques and/or training gloves known in the art and normally associated for use with prior art ball/bag designs is recommended whenever it is deemed necessary or desirable to protect the hands and wrists of the athlete training with the said punching ball. Training gloves in particular (FIG. 9*a*, FIG. 9*b*) may be crafted with padding of optimal shape and stiffness built into the knuckle portion 300 of said gloves 30. Other safety equipment possibilities may include a hand-wrapped glove hybrid to achieve similar protection, particularly for leather and microfiber embodiments discussed herein.

Likewise, knee and shin protection equipment may be combined with use of embodiments of the training ball described herein. It is expected that the likelihood of use of such protective equipment correlates positively with the intensity and duration of training. The likelihood that specific extremities (e.g. fists, wrists, knees, legs) would be targeted for use with such protective gear would likewise be positively correlated with frequency and intensity of involvement of such anatomy during the course of a training session.

It will be appreciated that training using any protective gear may nonetheless take place. In most cases, the decision to don protective gear rests with the athlete, who determines whether the stress and/or pain encountered justifies use of such equipment.

In embodiments where the compressibility of the outer layers of the ball is not implemented as discussed herein using materials and/or constructions that impart a lower coefficient of restitution (and therefore structural compressibility) to the outermost areas of the ball while retaining a higher coefficient of restitution for layers closer to the core, it will be appreciated that a similar compressibility may be achieved in part with the use of safety equipment such as training gloves 30. In such cases, the training gloves 30 compensate for the lacking synergy between embodiments of the ball and an athlete's bare fist. The gloves achieve this by replicating the compressibility that would ideally be achieved by decreasing the ball's outer coefficient of restitution to achieve compressibility that results in the momentary imprinting of the shape of an athlete's fist onto the ball. Said compressibility is replicated by transferring fist-to-ball shape-mating to the gloves 30 entirely, whose compressible material 300 achieves an analogous effect. A similar result may be achieved by wrapping the athlete's fists and knuckles with one or more compressive cloths, fabrics, textiles, and/or gels.

It will be appreciated that a practical limit exists on the practical duration of exercise using even an optimally matched embodiment, namely one with a generally high coefficient of restitution overall but with a lower coefficient of restitution at its extremities by an athlete before said athlete nonetheless experiences muscle pain and possible muscle and/or bone injury. In such a scenario, it will be appreciated that a mitigated variant of the aforementioned scenario may be envisioned. In this scenario, despite the somewhat more favorable conditions (as opposed to that in which an embodiment with excessive rebound characteristics is used), safety gloves 30 may be worn to extend the possible duration of training, thus maximizing benefits of optimized ball properties and protective gear.

Protection Equipment Bundled with Training Ball

Likewise, embodiments contemplated may include "kits" in which one or more embodiments of the ball may be bundled with one or more types of protective gear and/or other safety equipment.

What is claimed is:

1. A spherical punching ball specifically structured using a plurality of materials for continuous striking and rebounding against a wall for a purpose of training various punching techniques, said spherical punching ball having a core, a first layer of foam surrounding the core, a second layer of foam surrounding the first layer of foam, said first layer of foam having a higher density than said second layer of foam, and an outer shell material surrounding said second layer of foam, said core being made of a gel material, said spherical punching ball having a weight ranging from 500 g to 1300 g, a diameter of approximately 15 cm to 25 cm and a coefficient of restitution ranging from 0.45 to 0.70, wherein said outer shell material and said second layer of foam of said spherical punching ball are able to temporarily absorb and match a shape of a user's fist and have a lower coefficient of restitution than said coefficient of restitution of said spherical punching ball as a whole to facilitate the user's ability to direct said spherical punching ball toward said wall and to retain control of said spherical punching ball while it is aloft.

2. The spherical punching ball of claim 1 wherein said core is made of polyurethane gel.

3. The spherical punching ball of claim 1 further comprising a hooking mechanism for hanging said spherical punching ball from a ceiling or some other structure functional for a purpose of hanging said spherical punching ball as an optional training aid attachment.

4. The spherical punching ball of claim 1 wherein said spherical punching ball is structured for a predetermined range of skill and/or exertion level.

5. The spherical punching ball of claim 4 wherein said weight of said spherical punching ball ranges from 500 g to 1100 g, and said coefficient of restitution ranges from 0.50 to 0.60.

6. A method of training or exercising with a punching ball comprising:

providing the punching ball having a core, a first layer of foam surrounding the core, a second layer of foam surrounding the first layer of foam, said first layer of foam having a higher density than said second layer of foam, and an outer shell material surrounding said second layer of foam, said core being made of a gel material, said punching ball having a weight ranging from 500 g to 1300 g, a diameter of approximately 15 cm to 25 cm and a coefficient of restitution ranging from 0.45 to 0.70, wherein said outer shell material and said second layer of foam of said punching ball are able to temporarily absorb and match a shape of a user's fist and have a lower coefficient of restitution than said coefficient of restitution of said punching ball as a whole to facilitate the user's ability to direct said punching ball toward a wall and to retain control of said punching ball while it is aloft;

punching said punching ball with a directed upward thrust toward said wall from an initial distance and height from the wall such that said punching ball impacts on the wall higher than said height at which said punching ball is initially punched and bounces away from the wall and falls back to a distance from the wall and height corresponding roughly to the initial distance and height; and punching said punching ball repeatedly following each bounce away from the wall.

7. The method of claim 6 further comprising wearing gloves having compressible padding over a knuckle portion of said gloves while punching said punching ball.

8. The method of claim 6 wherein said punching ball is spherically shaped.

9. A method of training with a punching ball for the purpose of training various punching techniques comprising the steps:

providing the punching ball having a core, a first layer of foam surrounding the core, a second layer of foam surrounding the first layer of foam, said first layer of foam having a higher density than said second layer of foam, and an outer shell material surrounding said second layer of foam, said core being made of a gel material, said punching ball having a weight ranging from 500 g to 1300 g, a diameter of approximately 15 cm to 25 cm and a coefficient of restitution ranging from 0.45 to 0.70, wherein said outer shell material and said second layer of foam of said punching ball are able to temporarily absorb and match a shape of a user's fist and have a lower coefficient of restitution than said coefficient of restitution of said punching ball as a whole to facilitate the user's ability to direct said punching ball toward a wall and to retain control of said punching ball while it is aloft;

the user standing from one to about four feet (0.3 m to 1.2 m) facing said wall and, the user then punching said punching ball against the wall with a positive horizontal angle, causing said punching ball to bounce off the wall with a sufficient rebound positive horizontal angle to off-set a natural gravitational pull on said punching ball, and back to a general position of the user and, depending on a position and direction of said punching ball bouncing off the wall, the user may use any form of punching method or technique to allow the user to strike said punching ball back again against the wall as the user immediately prepares to again receive said punching ball bouncing off the wall and then, as said punching ball bounces off the wall back to the user, the user makes necessary calculated positional adjustments by way of quick foot work and/or body movement to enable the user to strike said punching ball again while attempting a best possible striking form and, with a purpose of bouncing said punching ball at an approximate ideal spot on the wall, the user providing the positive horizontal angle and a force that would cause said punching ball to bounce back to the general position of the user, whereby the user repeats this process for as long as a desired training target requires, or for as long as the user is able to maintain said punching ball in play.

* * * * *